US006325680B1

(12) United States Patent
Suzuki

(10) Patent No.: US 6,325,680 B1
(45) Date of Patent: Dec. 4, 2001

(54) FEMALE CONTACT FOR AN ELECTRICAL CONNECTOR

(75) Inventor: Mitsuru Suzuki, Kanagawa (JP)

(73) Assignee: Tyco Electronics. AMP, K.K., Kanagawa (JP)

( * ) Notice: Subject to any disclaimer, the term of this patent is extended or adjusted under 35 U.S.C. 154(b) by 0 days.

(21) Appl. No.: 09/736,831

(22) Filed: Dec. 14, 2000

(30) Foreign Application Priority Data

Dec. 28, 1999 (JP) ..... 11-374888

(51) Int. Cl.[7] ..... H01R 11/22
(52) U.S. Cl. ..... 439/852
(58) Field of Search ..... 439/852, 851, 439/746, 748, 872, 850

(56) References Cited

U.S. PATENT DOCUMENTS 3,796,987 * 3/1974 Kinkaid et al. ..... 439/748
3,836,947 * 9/1974 Yeager ..... 439/748
5,489,223 2/1996 Faje et al. ..... 439/748
6,045,415 * 4/2000 May et al. ..... 439/852

FOREIGN PATENT DOCUMENTS 1-116629 5/1989 (JP) .
2542184 4/1997 (JP) .

* cited by examiner

*Primary Examiner*—Brian Sircus
*Assistant Examiner*—Phuong KT Dinh

(57) ABSTRACT

A resilient contact section 32 and an embossment 36 that faces this resilient contact section 32 are formed on the pin receiving section 6 of a female contact 2. The mating pin 40 is electrically connected by being inserted between the above-mentioned resilient contact section 32 and embossment 36. A lance 50 is formed as an integral part of the embossment 36 so that this lance extends to the outside of the main body of the contact 2 from the embossment 36.

12 Claims, 6 Drawing Sheets

FEMALE CONTACT FOR AN ELECTRICAL CONNECTOR

FIELD OF THE INVENTION

The present invention relates to a female contact for an electrical connector and more specifically relates to a female contact which has a lance that engages with a housing in which this female contact is mounted.

BACKGROUND

Conventionally, female contacts mounted inside the cavities of connector housings are known to have lances that engage with the inside walls of the cavities. The contacts described in Japanese Utility Model Registration No. 2542184 and Japanese Patent Application Kokai No. H 11-16629, are universally known as examples of such female contacts. The connector disclosed in Japanese Utility Model Registration No. 2542184 is shown as one example in FIG. 6. This connector 200 has a housing 202 that has a cavity 204, and a socket contact 210 which is disposed inside the cavity 204. The socket contact 210 has on its front part a contact section 206 that accommodates a mating pin contact (not shown in the figures) and has an electrical wire connection section 212 that is connected to a cable 208. A lance 214 is formed between the contact section 206 and the electrical wire connection section 212 and this lance 214 engages with a recessed groove 216 in the housing 202, so that the socket contact 210 is anchored inside the housing. The lance 214 is separated in the axial direction from the contact section 206.

Similarly, in a relay connector disclosed in the latter Japanese Patent Application Kokai No. H 11-16629, the contact section and lance of the contact are disposed so that they are separated in the axial direction of the contact.

In the connector 200 disclosed in Japanese Utility Model Registration No. 2542184, the positions of the contact section 206 and lance 214 are separated in the axial direction thus increasing the dimensions of the socket contact 210 and the size of the housing 202. The same problem exists with the relay connector disclosed in the latter Japanese Patent Application Kokai No. H 11-16629.

SUMMARY

An object of the present invention is therefore to provide a compact female contact and a compact electrical connector. A female contact is provided having a main body for receiving a pin. The female contact has a resilient contact section positioned at a front end and an embossment also positioned at the front end opposite the resilient contact section such that a mating pin is receivable between the embossment and the resilient contact section. The embossment also has a lance extending outward away from the resilient contact section.

BRIEF DESCRIPTION OF THE DRAWINGS

The invention will now be described by way of example with reference to the accompanying figures of which:

FIG. 1 shows the female contact of the present invention.

FIG. 1 is unfolded and shown along with the carrier.

FIG. 3 shows the housing used in the electrical connector of the present invention.

FIG. 4 shows the housing used in the electrical connector of the present invention.

DETAILED DESCRIPTION OF THE PREFERRED EMBODIMENT

Figure 1A:
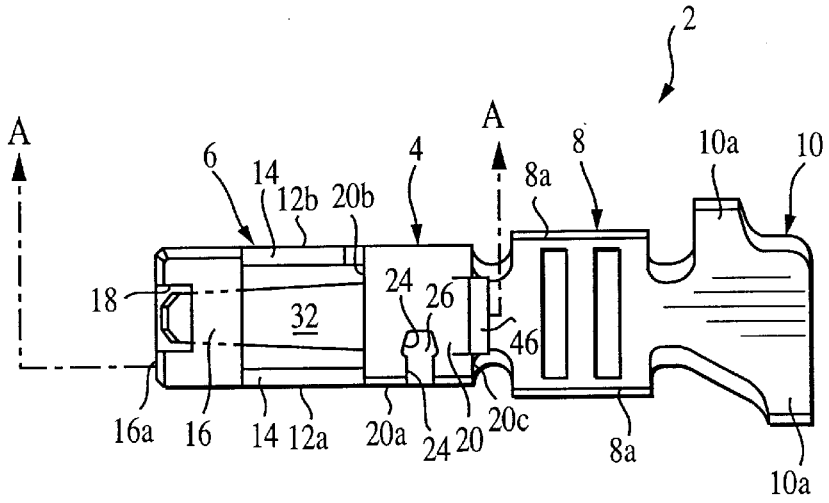
FIG. 1(A) is a plan view.

Preferred embodiments of the female contact of the present invention and an electrical connector using this female contact will be described in detail with reference to the attached figures. FIG. 1 shows the female contact of the present invention. FIG. 2 is an unfolded view in which the contact 2 shown in FIG. 1 is unfolded and shown along with the carrier 46. As is shown in FIG. 2, the contact 2 is formed by stamping and forming a single metal plate. The contact main body 4 is substantially box-shaped, and has a pin receiving section 6 at the front, a termination section 8 disposed behind the pin receiving section 6 and an insulator crimp section 10 at the rear behind the termination section 8. The main body 4 has a set of side walls 12*a* and 12*b* that extend parallel to each other toward the pin receiving section 6. A bridge 16 which extends from the upper edge 14 of one side wall 12*a* to the upper edge 14 of the other side wall 12*b* is formed on the front ends of the side walls 12. The bridge 16 and side wall 12*b* can be joined by welding using ultrasound, laser, or other suitable techniques. A rectangular cut-out 18 is formed in the end 16*a* of the bridge 16 and is arranged so that the end 32*b* of a resilient contact section 32 can be accommodated therein.

In the rear of the main body 4, a connecting member 20 extends from the upper edge 14 of the side wall 12*b*, to the upper edge 14 of the other side wall 12*a*. A cut-out 24 which has a large-diameter curved member 22 at its innermost end is formed in the end edge 20*a* of the connecting member 20. A tongue 26 with a shape that is complementary to the shape of the cut-out 24 protrudes from the upper edge 14 of the side wall 12*a*. The side walls 12*a* and 12*b* are connected by the engagement of this tongue 26 with the cut-out 24. As a result of the large-diameter curved member 22, the connecting member 20 and tongue 26 can resist a force that tends to pull the parts apart in the lateral direction, so that a firm connection is made.

The termination section 8 formed as an integral part at the rear of the main body 4 has conductor barrels 8*a* formed in upright positions on both sides. The insulator crimp section 10, which is formed as a continuation of the termination section 8 behind the termination section 8, has insulator barrels 10*a* whose positions are shifted in the axial direction of the contact 2.

A resilient contact section 32 extends from the side edge 20*b* of the connecting member 20 toward the inside of the pin receiving section 6, as is shown most clearly in FIGS.

1(A) and 1(D). This resilient contact section 32 is positioned between the side walls 12*a* and 12*b*. The front part 32*a* of this resilient contact section 32 is inclined upward, and the end 32*b* is positioned in the cut-out 18 of the bridge 16. An embossment 36 which is extruded from a die is formed in the bottom wall 34 of the pin receiving section 6 such that it protrudes toward the resilient contact section 32. A lance 50 is integrally formed as a continuation of this embossment 36. When the lance 50 is punched out, slots 11 and 13 are formed on both sides of the lance 50 (FIG. 2). As a result, the lance 50 can bend without interfering with the side walls 12 or bottom wall 34.

As a result of the above-mentioned lance 50 being punched out, an opening 42 which includes the slots 11 and 13 is formed in the bottom wall 34 of the pin receiving section 6, and the lance 50 extends at an inclination toward the outside and rear of the main body 4 from this opening 42. The distance between the embossment 36 and lance 50 along the axial direction of the contact 2 is shortened, so that the pin receiving section 6 can be shortened. Consequently the contact 2 can be made more compact. The mating pin 40 (FIG. 5) advances into the space between the resilient contact section 32 and embossment 36 so that an electrical connection is established. A reinforcing bead 15 is formed in the axial direction of the contact 2 on the bottom part of the main body 4.

Figure 1B:
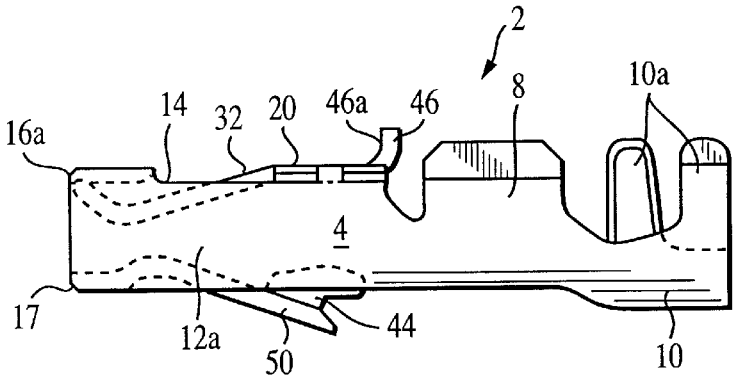
FIG. 1(B) is a side view.
Figure 1C:
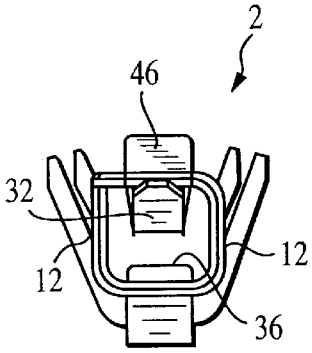
FIG. 1(C) is a front view.
Figure 1D:
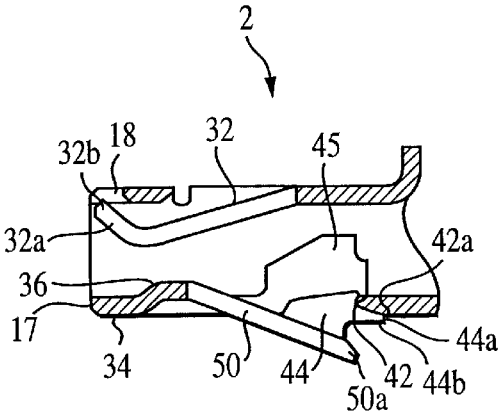
FIG. 1(D) is a partial sectional view along section A—A of the female contact shown in FIG. 1(A).
Figure 2:
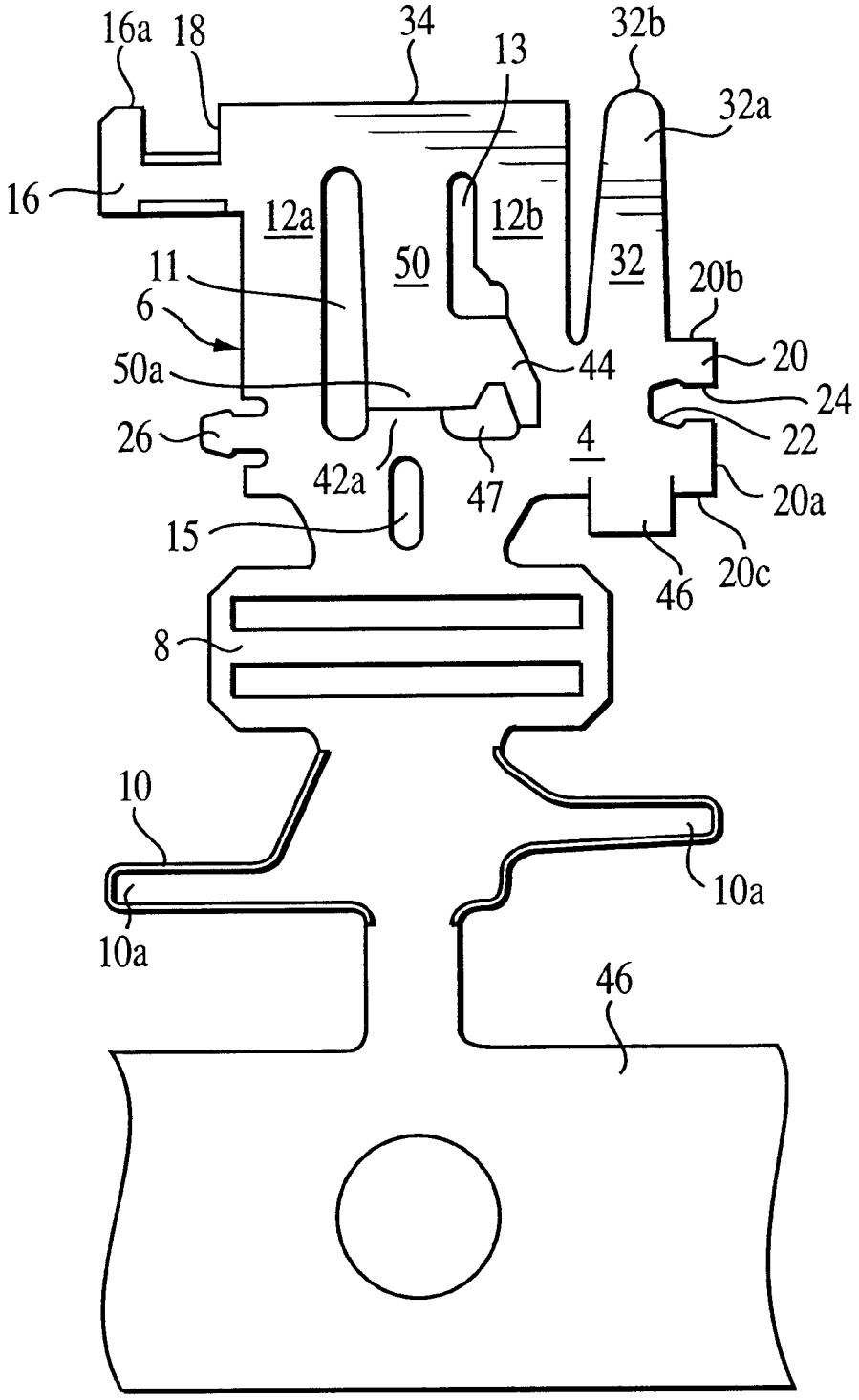
FIG. 2 is an unfolded view in which the contact shown

As is shown in FIGS. 1(B) and 1(D), the tip end 50*a* of the lance 50 is coined so that the total length of the lance 50 is slightly lengthened. The outside of the edge 42*a* of the opening 42 facing is also coined so that this surface extends slightly into the opening 42. As a result, when the lance tends to be pushed into the opening 42 by an external force the end 50*a* of the lance 50 can contact the edge 42*a*, to prevent the lance 50 from being pushed into the opening 42.

The coining can optionally be performed on either the end 50*a* or the edge 42*a*, however, it is preferred to coin both parts 50*a* and 42*a*. In cases where coining is performed on both the lance 50 and the edge 42, the length by which the end 50*a* protrudes from the main body 4 when the end 50*a* of the lance 50 contacts the end edge 42*a* of the main body 4 can be minimized. As a result, when the contact 2 is mounted in the corresponding cavity 130 (FIG. 3) of the housing 100, the end 50*a* of the lance 50 can be prevented from interfering with or damaging the inside wall of the cavity 130. Furthermore, since the inside dimensions of the cavity 130 can be reduced, the housing 100 can also be made more compact.

A projection 44 is bent at substantially a right angle on one edge of the lance 50. This projection 44 has a protruding part 44*a* which extends upward at an inclination from the edge of the lance 50 beyond the end 50*a* and has a downward-facing edge 44*b*. In the vicinity of the edge 42*a*, the projection 44 passes through an opening 47 (shown in FIG. 2) so that it can protrude slightly to the outside of the main body 4 of the contact 2 as shown in FIG. 1D. As a result, the lance 50 can easily bend toward the outside. A stopper 46 extends upward and has a forward-facing surface 46*a* that is perpendicular to the axis of the contact 2 and protrudes from the side edge 20*c* of the connecting member 20.

Figure 3A:
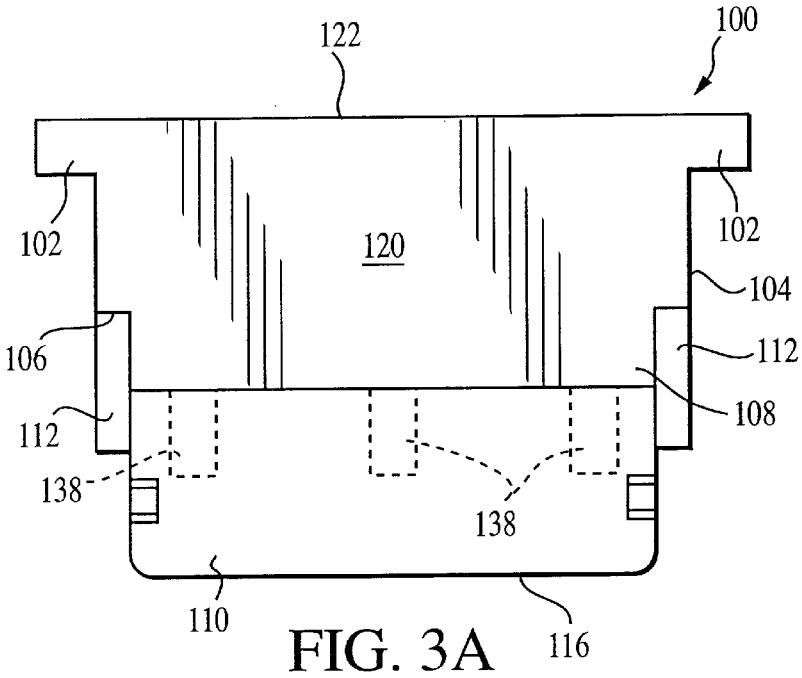
FIG. 3(A) is a plan view of the housing.

Next, the housing used in the connector 1 will be described with reference to FIGS. 3 and 4. The three contact housing 100 is integrally molded from an insulating material and is formed substantially in the shape of a rectangular solid. Flanges 102 are disposed on both sides of the rear part of the main body 120. The front part is slightly narrowed via steps 106 from the side surfaces 104 of the housing 100 to form an engaging member 110. Guide rails 112 extend forward from the steps 106 along the side surfaces 104. These guide rails 112 extend from portions near the upper surface 108 of the housing 100, and act as guides for the purpose of smooth engagement in cooperation with recessed parts (not shown in the figures) in the mating connector 170 (FIG. 5,) during mating In the engaging member 110, as is shown most clearly in FIG. 3(B), recessed grooves 118 extend from the engaging surface 116 to the main body 120. Three cavities 130 extend from the engaging surface 116 to the rear end 122 of the housing 100. The contacts 2 are inserted into these cavities 130 and fastened in place.

Figure 3B:
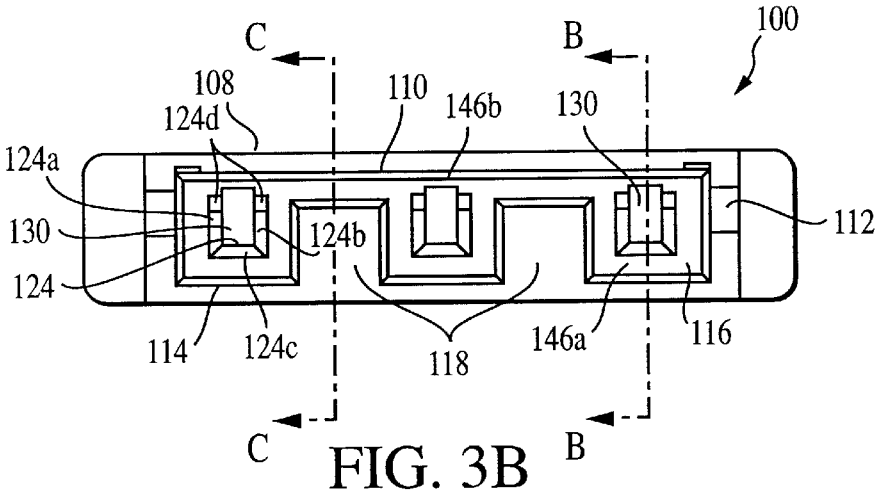
FIG. 3(B) is a front view.
Figure 3C:
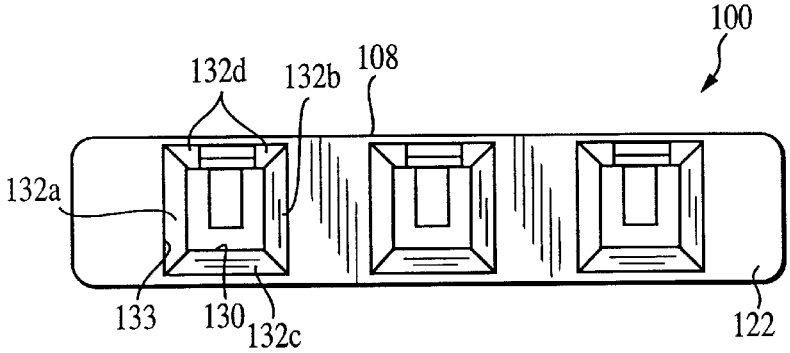
FIG. 3(C) is a back view.
Figure 4A:
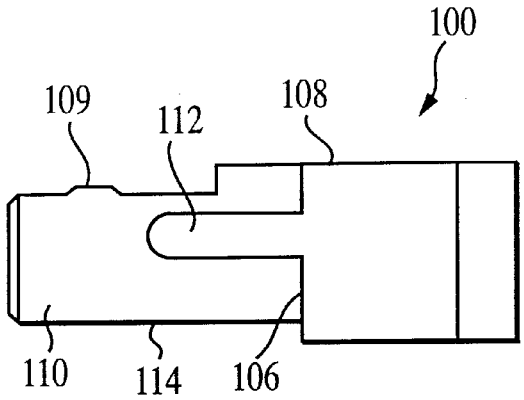
FIG. 4(A) is a side view.
Figure 4B:
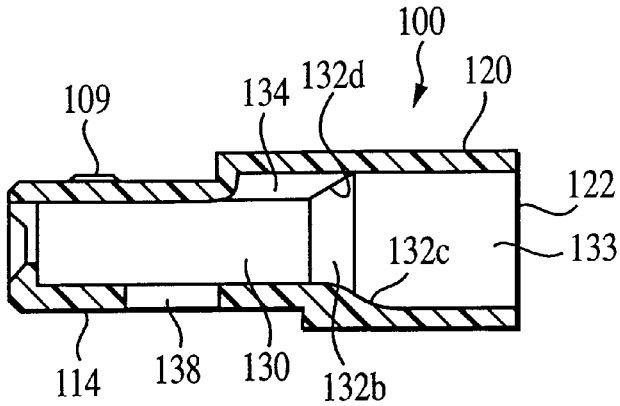
FIG. 4(B) is a B—B sectional view in which the housing shown in FIG. 3(B) is sectioned along line B—B.
Figure 4C:
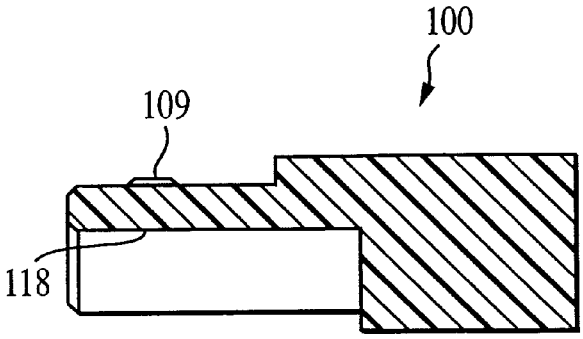
FIG. 4(C) is a C—C sectional view in which the housing shown in FIG. 3(B) is sectioned along line C—C.

Tapers 124*a*, 124*b*, 124*c* and 124*d* are formed around rectangular openings 124 at the front ends of the cavities 130, so that the mating male contacts 40 are guided during mating as is shown most clearly in FIG. 3(B).

The contacts 2 are inserted into the housing 100 from the openings 133 of the cavities 130. As is shown most clearly in FIG. 3(C), similar tapers 132*a*, 132*b*, 132*c* and 132*d* are formed around the intermediate parts of the cavities 130, and these tapers act as guides during the mounting of the contacts 2. As is shown most clearly in FIG. 4(B), grooves 134 extend into the cavities 130 from intermediate positions on the tapers 132*d*. The stoppers 46 of the contacts 2 advance into these grooves 134. As is shown most clearly in the same figure, the internal dimensions of the cavities 130 increase via the tapers 132*c* toward the rear of the main body to accommodate the insulator crimp sections 10 of the contacts 2. Anchoring holes 138 are formed near the center in the undersurface 114 of the engaging part 110. The lances 50 are disposed in these anchoring holes 138. A projection 109 is engaged by a mutual detent engagement at the time of mating with the mating connector 170 so that the connectors are anchored to each other.

Figure 5:
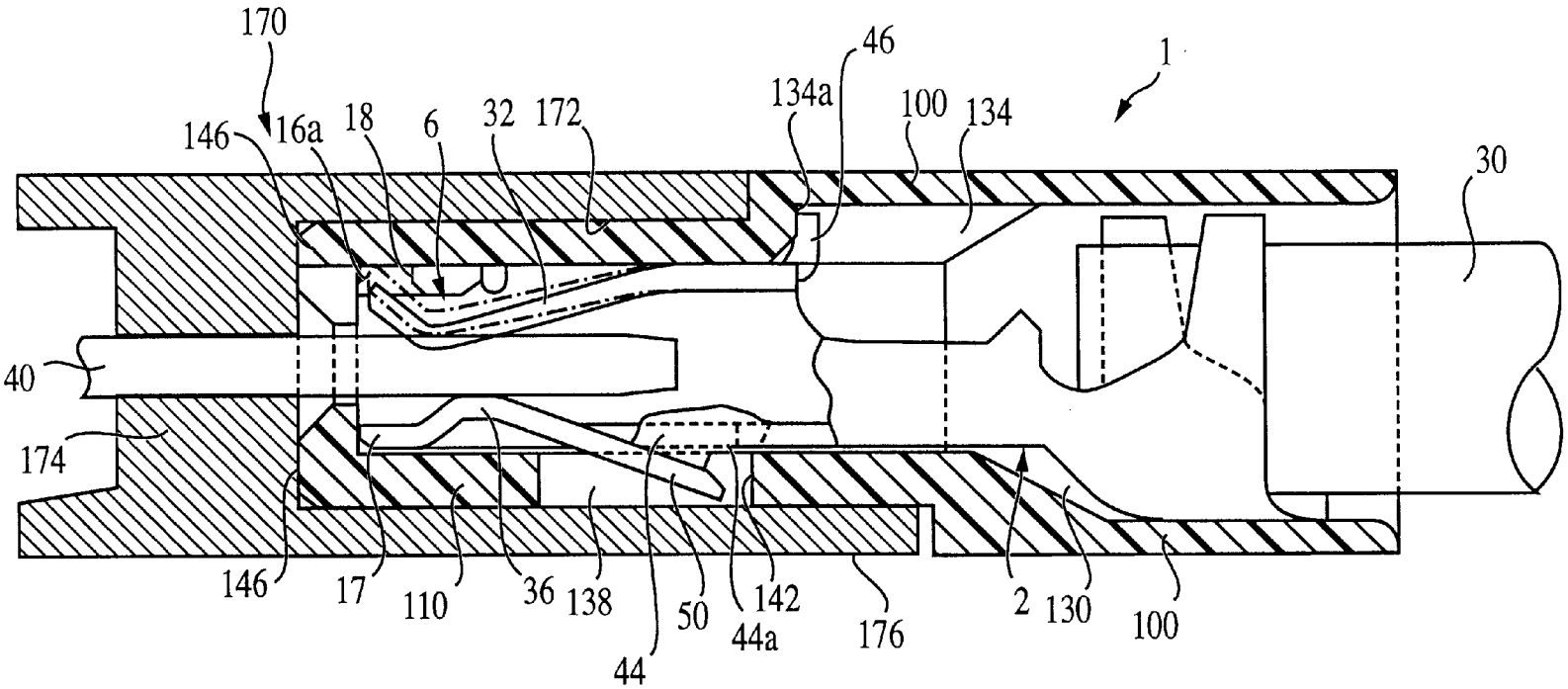
FIG. 5 shows a schematic longitudinal sectional view of the state in which the connector of the present invention is engaged with the mating header connector.
Figure 6:
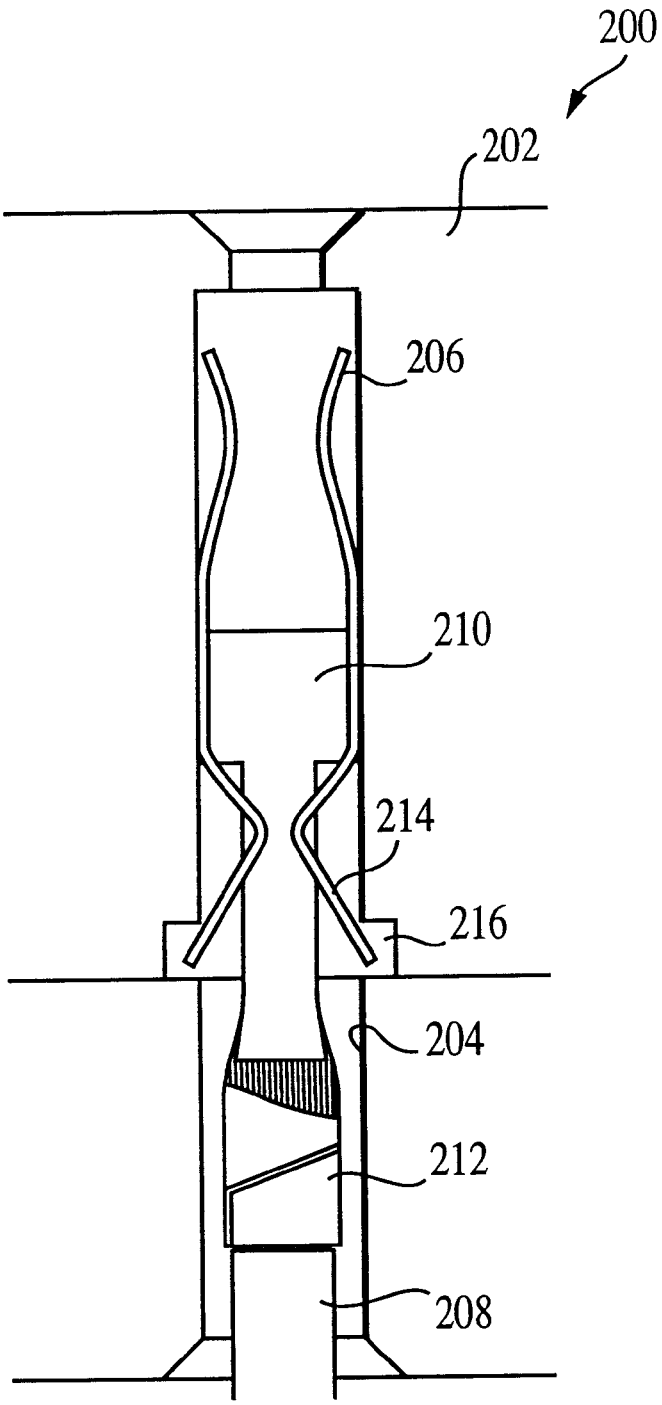
FIG. 6 PRIOR ART
FIG. 6 is a basic structural diagram which shows one example of a prior art electrical connector.

Next, FIG. 5 shows a sectional view of the connector 1 mated with the mating header connector. As is shown in FIG. 5, the header connector 170 has an engaging recess 172, and pins 40 are secured in the bottom wall 174 of this engaging recess 172 in positions facing the contacts 2.

When the contacts 2 are inserted into the cavities 130 of the housing 100 during the assembly of the connector 1, the lances 50 are positioned inside the anchoring holes 138 of the housing 100. As a result, even if it is attempted to pull the contacts 2 out of the housing 100, the lances 50 engage with the inside walls 142 of the anchoring holes 138, so that the contacts 2 cannot be pulled out. In a case where the contacts 2 are pulled so as to cause the contacts 2 to slip out of the housing 100 after the lances 50 have been attached to the housing 100, the protrusions 44*a* of the lances 50 contact the areas in the vicinities of the anchoring holes 138 of the housing 100 when the lances begin to protrude to the outside from the anchoring holes 138, so that further displacement of the lances 50 to the outside is prevented. Accordingly, the lances 50 have a large resistance to any force that tends to cause the contacts 2 to be pulled out.

The stoppers 46 of the contacts 2 contact the end walls 134*a* of the grooves 134 as shown in the figures. As a result, the contacts 2 can be prevented from being over inserted into the cavities 130. Furthermore, since the stoppers 46 protrude from the upper walls 16 and 20 upside-down insertion of the contacts 2 is prevented.

When the connector 1 in which the contacts 2 and housing 100 have been assembled is engaged with the engaging recess 172 of the above-mentioned header connector 170, the engaging member 110 of the connector 1 is inserted into the engaging recess 172. The resilient contact sections 32 contact the pins 40, and are elastically displaced from the normal positions indicated by the solid line to the positions indicated by the dotted line. Here, since the ends 32*b* of the resilient contact sections 32 are positioned inside the cutouts 18, the action of the resilient contact sections 32 is not restricted. Since the embossments 36 have the lances 50 extending from an intermediate point, these embossments 36 have a slight elasticity. Accordingly, when the embossments 36 engage the pins 40, they are displaced slightly outward so that the lances 50 move slightly to the outside.

A preferred embodiment of the present invention was described in detail above. However, this embodiment is merely an example, and the present invention is not limited to this embodiment. For example, it will be readily apparent to a person skilled in the art that the shapes of the resilient contact sections and embossments can be altered in accordance with the shape of the connector without departing from the spirit of the present invention. In the contacts, furthermore, the resilient contact sections may be constructed using additional separate parts instead of using a single metal plate.

What is claimed is:

1. A female contact having a main body for receiving a pin comprising:

a resilient contact section positioned at a front end;

an embossment also positioned at the front end opposite the resilient contact section such that the pin is receivable between the embossment and the resilient contact section, the embossment having a lance extending outward away from the resilient contact section; and an opening formed in the main body adjacent the lance, wherein edges of the opening are coined to reduce the opening size.

2. The female contact of claim 1 wherein the lance further comprises a coined section at a free end.

3. The female contact of claim 1 wherein the lance further comprises a projection extending into engagement with a rear edge of the opening.

4. A closed female contact having a resilient contact section positioned opposite an embossment characterized in that a lance extends outward from the embossment in a direction opposite the resilient contact section to be engageable with a housing opening of a housing cavity, a contact opening is provided on the contact wherein edges of the contact opening are coined to reduce the size of the contact opening.

5. The female contact of claim 4 wherein the lance further comprises a coined section at a free end.

6. The female contact of claim 4 wherein the contact opening is formed in the main body adjacent the lance.

7. The female contact of claim 6 wherein the lance further comprises a projection extending into engagement with a rear edge of the opening.

8. A female contact having a main body for receiving a pin comprising:

a resilient contact section positioned at a front end;

an embossment also positioned at the front end opposite the resilient contact section such that the pin is receivable between the embossment and the resilient contact section, the embossment having a lance extending outward away from the resilient contact section;

an opening formed in the main body adjacent the lance, the lance having a projection extending into engagement with a rear edge of the opening.

9. The female contact of claim 8 wherein the lance further comprises a coined section at a free end.

10. The female contact of claim 8 wherein edges of the opening are coined to reduce the opening size.

11. A closed female contact having a resilient contact section positioned opposite an embossment characterized in that a lance extends outward from the embossment in a direction opposite the resilient contact section to be engageable with a housing opening of a housing cavity, a contact opening formed in a main body of the contact adjacent the lance, the lance having a projection which extends into engagement with the contact opening.

12. The female contact of claim 11 wherein the lance further comprises a coined section at a free end.

* * * * *